US009028207B2

(12) United States Patent
Zuniga et al.

(10) Patent No.: US 9,028,207 B2
(45) Date of Patent: May 12, 2015

(54) COOLED COMPONENT WALL IN A TURBINE ENGINE

(75) Inventors: Humberto A. Zuniga, Casselberry, FL (US); Ching-Pang Lee, Cincinnati, OH (US); Michael E. Crawford, Kirkland, WA (US)

(73) Assignee: Siemens Energy, Inc., Orlando, FL (US)

( * ) Notice: Subject to any disclaimer, the term of this patent is extended or adjusted under 35 U.S.C. 154(b) by 1009 days.

(21) Appl. No.: 12/888,467

(22) Filed: Sep. 23, 2010

(65) Prior Publication Data

US 2012/0076644 A1 Mar. 29, 2012

(51) Int. Cl.
*F01D 5/18* (2006.01)

(52) U.S. Cl.
CPC ..... *F01D 5/186* (2013.01); *Y10T 29/4935* (2015.01); *F05D 2230/90* (2013.01); *F05D 2250/13* (2013.01); *F05D 2250/324* (2013.01)

(58) Field of Classification Search
CPC ..... F01D 5/186; F01D 5/187; Y10T 29/4935; F05D 2230/90; F05D 2250/13; F05D 2250/324
USPC ..... 415/115, 116; 417/96 R, 97 A, 97 R; 29/889.721
See application file for complete search history.

(56) References Cited

U.S. PATENT DOCUMENTS 5,223,320 A * 6/1993 Richardson ..... 428/137
5,458,461 A 10/1995 Lee et al.
5,605,639 A 2/1997 Banks et al.
5,651,662 A 7/1997 Lee et al.
5,660,525 A 8/1997 Lee et al.
5,683,600 A 11/1997 Kelley et al.
5,902,647 A 5/1999 Venkataramani et al.
6,234,755 B1 * 5/2001 Bunker et al. ..... 416/97 R
6,307,175 B1 10/2001 Blochlinger et al.
6,383,602 B1 * 5/2002 Fric et al. ..... 428/131
6,617,003 B1 9/2003 Lee et al.
7,328,580 B2 2/2008 Lee et al.

(Continued)

FOREIGN PATENT DOCUMENTS

DE 102007038858 A1 3/2008
EP 1043480 A2 10/2000

(Continued)

OTHER PUBLICATIONS

Ching-Pang Lee et al.; U.S. Appl. No. 12/813,602, filed Jun. 11, 2010; entitled "Film Cooled Component Wall in a Turbine Engine".

(Continued)

*Primary Examiner* — Dwayne J White
*Assistant Examiner* — Adam W Brown

(57) ABSTRACT

A component wall in a turbine engine includes a substrate, a diffusion section, and at least one cooling passage. The diffusion section is located in a surface of the substrate and is defined by a first sidewall and a second sidewall. The cooling passage(s) include an outlet portion through which cooling air exits in a direction toward the first sidewall. The outlet portion includes a rear section, a front section, and an inner wall having proximal and distal ends. The rear section is located between the first and second sidewalls. The front section extends between the first sidewall and the distal end of the inner wall. The first sidewall extends into the outlet portion of the cooling passage(s) to the inner wall and extends from the first lateral wall to the second lateral wall so as to block the front section of the outlet portion.

11 Claims, 6 Drawing Sheets

(56) References Cited

U.S. PATENT DOCUMENTS

| | | | | |
|---|---|---|---|---|
| 7,351,036 | B2 | 4/2008 | Liang | |
| 7,411,150 | B2 | 8/2008 | Lavers et al. | |
| 7,553,534 | B2 * | 6/2009 | Bunker | 428/137 |
| 8,608,443 | B2 | 12/2013 | Lee et al. | |
| 2005/0135931 | A1 * | 6/2005 | Nakamata et al. | 416/97 R |
| 2008/0057271 | A1 | 3/2008 | Bunker | |
| 2008/0286090 | A1 * | 11/2008 | Okita | 415/115 |
| 2008/0298920 | A1 | 12/2008 | Janssen et al. | |
| 2009/0067998 | A1 | 3/2009 | Beck et al. | |
| 2009/0246011 | A1 | 10/2009 | Itzel | |
| 2011/0097188 | A1 * | 4/2011 | Bunker | 415/1 |
| 2011/0293423 | A1 * | 12/2011 | Bunker et al. | 416/95 |
| 2011/0300000 | A1 * | 12/2011 | Beck et al. | 416/97 R |

FOREIGN PATENT DOCUMENTS

| | | | |
|---|---|---|---|
| EP | 1091090 | A2 | 4/2001 |
| GB | 2438861 | A1 | 12/2007 |
| JP | 10089005 | A | 4/1998 |

OTHER PUBLICATIONS

Ching-Pang Lee et al.; U.S. Appl. No. 12/813,624, filed Jun. 11, 2010; entitled "Component Wall Having Diffusion Sections for Cooling in a Turbine Engine".

Varvel, Trent Alan; "Shaped Hole Effects on Film Cooling Effectiveness and a Comparison of Multiple Effectiveness Measurement Techniques"; Master of Science Thesis; pp. 1-88; Dec. 2004; Texas A&M University.

Colban, IV, William F.; "A Detailed Study of Fan-Shaped Film-Cooling for a Nozzle Guide Vane for an Industrial Gas Turbine"; Ph.D. Dissertation; pp. 1-174; Nov. 28, 2005; Virginia Polytechnic Institute and State University; Blacksburg, VA.

Lu, Yiping; "Effect of Hole Configurations on Film Cooling From Cylindrical Inclined Holes for the Application to Gas Turbine Blades"; Ph.D. Dissertation; pp. 1-109 ; Dec. 2007; Louisiana State University.

* cited by examiner

COOLED COMPONENT WALL IN A TURBINE ENGINE

FIELD OF THE INVENTION

The present invention relates to turbine engines, and, more particularly, to cooling passages provided to component walls, such as the wall of an airfoil in a gas turbine engine.

BACKGROUND OF THE INVENTION

In a turbomachine, such as a gas turbine engine, air is pressurized in a compressor then mixed with fuel and burned in a combustor to generate hot combustion gases. The hot combustion gases are expanded within a turbine of the engine where energy is extracted to power the compressor and to provide output power used to produce electricity. The hot combustion gases travel through a series of turbine stages. A turbine stage may include a row of stationary airfoils, i.e., vanes, followed by a row of rotating airfoils, i.e., turbine blades, where the turbine blades extract energy from the hot combustion gases for powering the compressor and providing output power.

Since the airfoils, i.e., vanes and turbine blades, are directly exposed to the hot combustion gases as the gases pass through the turbine, these airfoils are typically provided with internal cooling circuits that channel a coolant, such as compressor bleed air, through the airfoil and through various film cooling holes around the surface thereof. For example, film cooling holes are typically provided in the walls of the airfoils for channeling the cooling air through the walls for discharging the air to the outside of the airfoil to form a film cooling layer of air, which protects the airfoil from the hot combustion gases.

Film cooling effectiveness is related to the concentration of film cooling fluid at the surface being cooled. In general, the greater the cooling effectiveness, the more efficiently the surface can be cooled. A decrease in cooling effectiveness causes greater amounts of cooling air to be employed to maintain a certain cooling capacity, which may cause a decrease in engine efficiency.

SUMMARY OF THE INVENTION

In accordance with a first aspect of the present invention, a component wall is provided in a turbine engine. The component wall comprises a substrate, a diffusion section, and at least one cooling passage. The substrate has a first surface and a second surface opposed from the first surface. The diffusion section is located in the second surface and is defined by a first sidewall and a second sidewall spaced from the first sidewall, wherein the first and second sidewalls extend radially outwardly to the second surface. The at least one cooling passage comprises a throat portion extending through the substrate and an outlet portion through which cooling air exits in a direction toward the first sidewall. The outlet portion of each cooling passage comprises an inner wall, a rear section, a front section, a first lateral wall, and a second lateral wall. The inner wall defines an inner surface of the outlet portion and has a proximal end located adjacent to the throat portion and a distal end. The rear section is located between the first and second sidewalls. The front section extends between the first sidewall and the distal end of the inner wall. The first lateral wall extends radially outwardly from the inner wall and extends from the rear section to the front section. The second lateral wall is opposed from the first lateral wall and extends radially outwardly from the inner wall from the rear section to the front section. The first sidewall extends into the outlet portion of each cooling passage to the inner wall and extends from the first lateral wall to the second lateral wall so as to block the front section of the outlet portion.

In accordance with a second aspect of the present invention, a method is provided for forming a diffusion section in a component wall of a turbine engine. An outer surface of an inner layer of the component wall is masked with a removable material so as to define a shape of a diffusion section to be formed in the component wall. The removable material blocks a rear section of an outlet portion of at least one cooling passage extending through the inner layer of the component wall. The removable material does not block a front section of each cooling passage outlet portion. A material is disposed on the outer surface of the inner layer and into the front section of each cooling passage outlet portion all the way down to an inner wall of the outlet portion of each cooling passage to form an outer layer of the component wall over the inner layer. The inner wall of each cooling passage outlet portion defines an inner surface of the outlet portion. The removable material is removed from the component wall such that a diffusion section is formed in the component wall where the removable material was previously located. The diffusion section is defined by a first sidewall and a second sidewall. The first sidewall is defined by the material forming the outer layer of the component wall and is located proximate to the front section of each cooling passage outlet portion. The second sidewall is spaced from the first sidewall, is defined by the material forming the outer layer of the component wall, and is located proximate to the rear section of each cooling passage outlet portion. Removing the removable material unblocks the rear section of each cooling passage outlet portion such that cooling air is able to pass through each cooling passage and out of the unblocked rear section toward the first sidewall.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
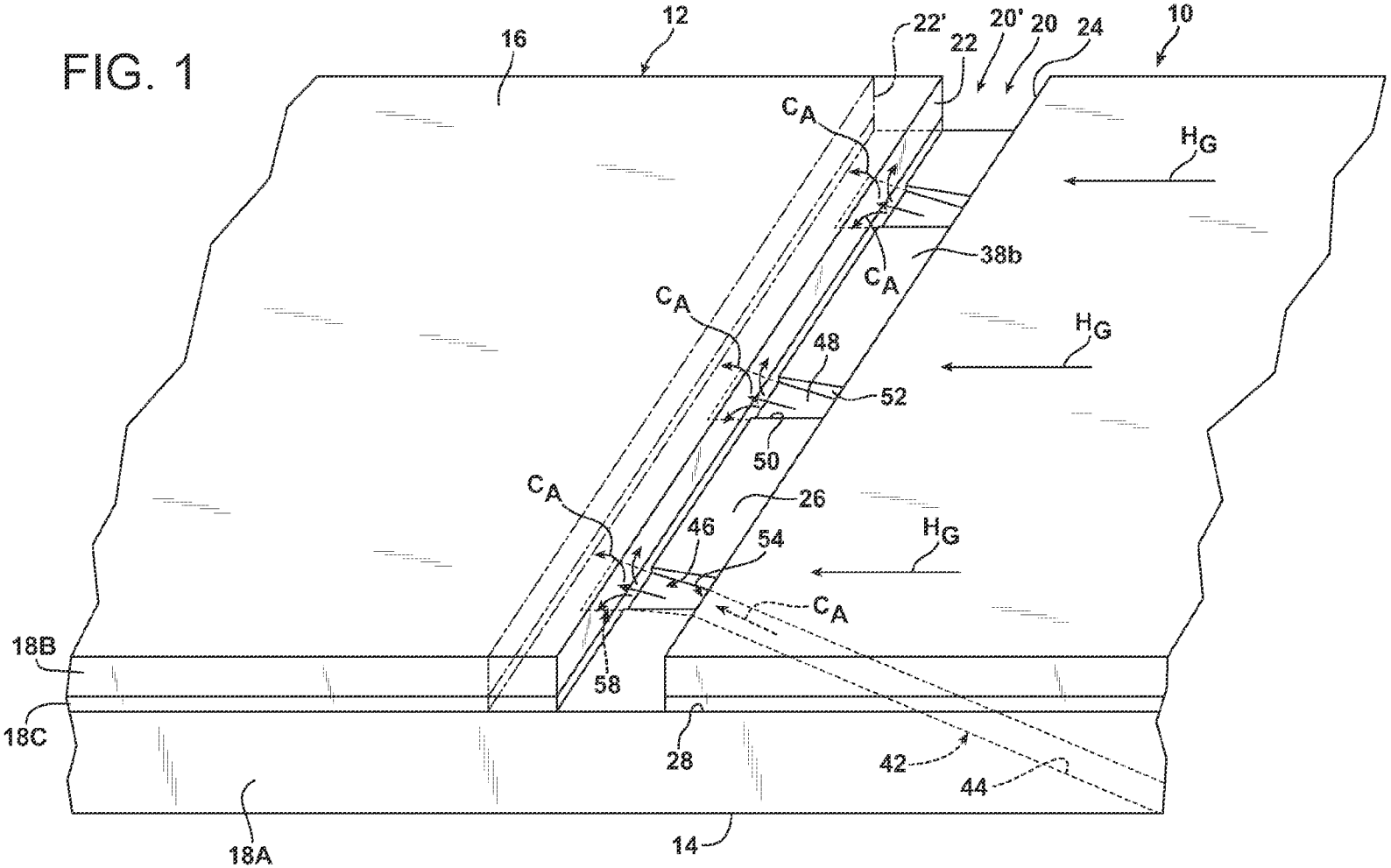
FIG. 1 is a perspective view of a portion of a cooled component wall according to an embodiment of the invention.

Referring to FIG. 1, a film cooled component wall 10 according to an embodiment of the invention is shown. The component wall 10 may comprise a portion of a component in turbine engine, such as an airfoil, i.e., a rotating turbine blade or a stationary vane, the inner and/or outer platform/shroud/hub of a vane, the outer hub/shroud/air seal of a blade, a combustion liner, an exhaust nozzle, and the like.

The component wall 10 comprises a substrate 12 having a first surface 14 and a second surface 16. The first surface 14 may be referred to as the "cool" surface, as the first surface 14 may be exposed to cooling air, while the second surface 16 may be referred to as the "hot" surface, as the second surface 16 may be exposed to hot combustion gases during operation. Such combustion gases may have temperatures of up to about 2,000° C. during operation of the engine. In the embodiment shown, the first surface 14 and the second surface 16 are opposed and substantially parallel to each other.

The material forming the substrate 12 may vary depending on the application of the component wall 10. For example, for turbine engine components, the substrate 12 preferably comprises a material capable of withstanding typical operating conditions that occur within the respective portion of the engine, such as, for example, ceramics and metal-based materials, e.g., steel or nickel, cobalt, or iron based superalloys, etc.

Figure 2:
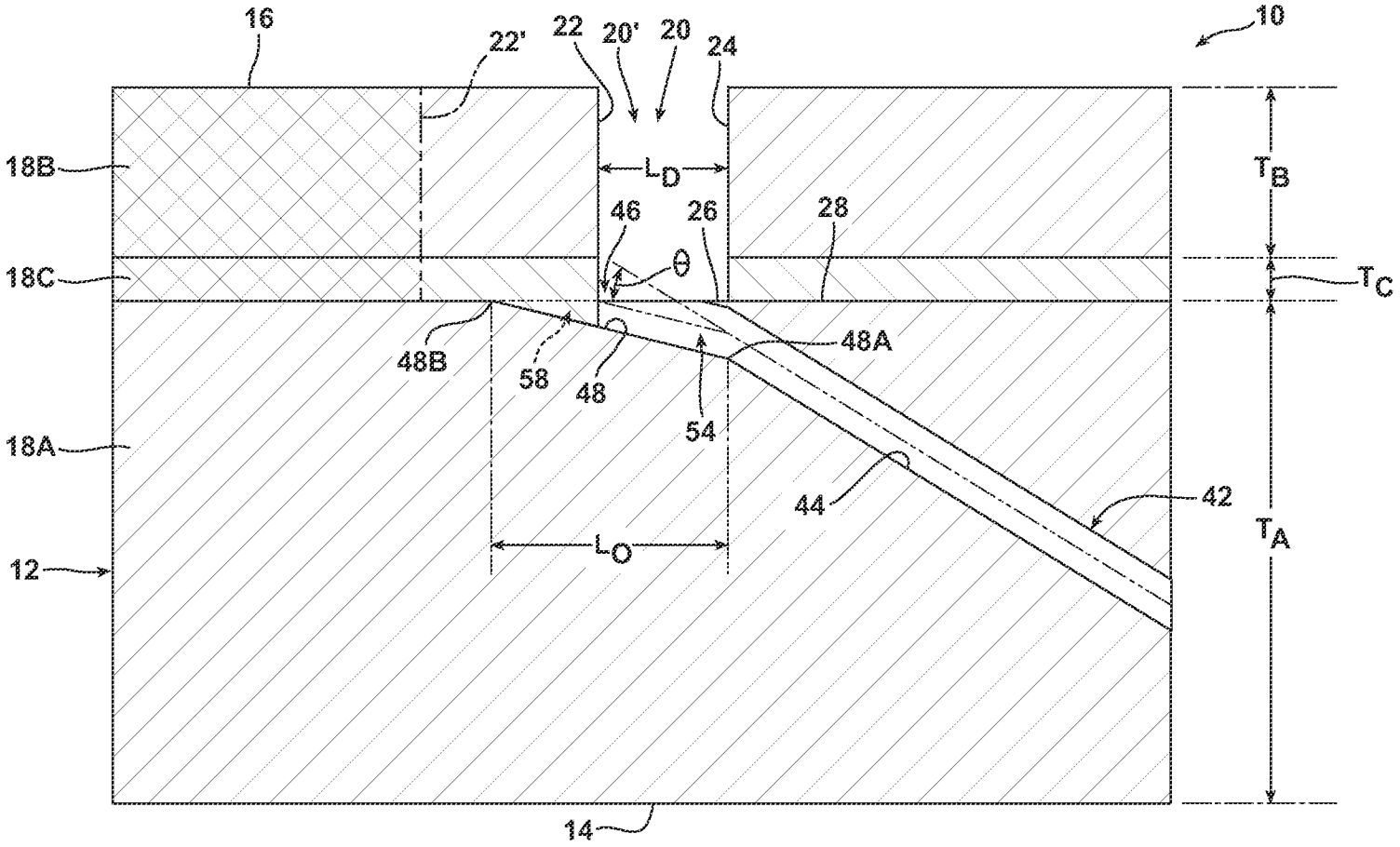
FIG. 2 is a side cross sectional view of the cooled component wall shown in FIG. 1.

Referring additionally to FIG. 2, the substrate 12 may comprise one or more layers, and in the embodiment shown comprises an inner layer 18A, an outer layer 18B, and an intermediate layer 18C between the inner and outer layers 18A, 18B. The inner layer 18A in the embodiment shown comprises, for example, steel or a nickel, cobalt, or iron based superalloy, and, in one embodiment, may have a thickness $T_A$ of about 1.2 mm to about 2.0 mm, see FIG. 2. The outer layer 18B in the embodiment shown comprises a thermal barrier coating that is employed to provide a high heat resistance for the component wall 10, and, in one embodiment, may have a thickness $T_B$ of about 0.5 mm to about 1.0 mm. The intermediate layer 18C in the embodiment shown comprises a bond coat that is used to bond the outer layer 18B to the inner layer 18A, and, in one embodiment, may have a thickness $T_C$ of about 0.1 mm to about 0.2 mm. While the substrate 12 in the embodiment shown comprises the inner, outer, and intermediate layers 18A, 18B, 18C, it is understood that substrates having additional or fewer layers could be used. For example, the thermal barrier coating, i.e., the outer layer 18B, may comprise a single layer or may comprise more than one layer. In a multi-layer thermal barrier coating application, each layer may comprise a similar or a different composition and may comprise a similar or a different thickness. It is noted that the terms "inner", "outer", "radially", "laterally", "bottom", "top", and the like, as used herein, are not intended to be limiting with regard to orientation of the elements recited for the present invention.

Figure 3:
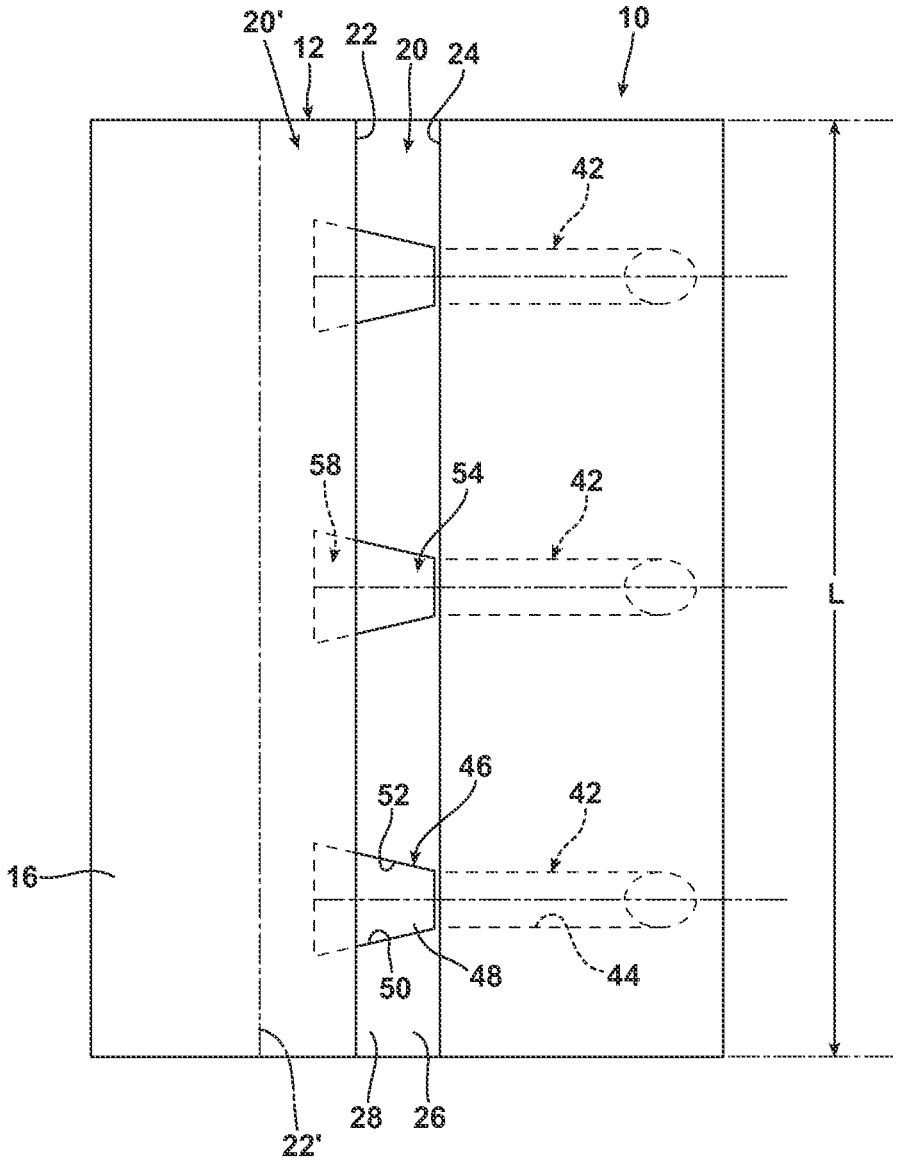
FIG. 3 is a top plan view of the cooled component wall shown in FIG. 1.

As shown in FIGS. 1-3, a diffusion section comprising a trench 20, otherwise referred to as a slot, is formed in the component wall 10. The trench 20 is formed in the second surface 16 of the substrate 12, i.e., the trench 20 extends through the outer layer 18B or both the outer and intermediate layers 18B, 18C in the embodiment shown (see FIG. 2), and extends longitudinally across the second surface 16.

The trench 20 comprises a first sidewall 22, a second sidewall 24 spaced from the first sidewall 22, and a bottom surface 26. It is noted that the first sidewall 22 is downstream from the second sidewall 24 with respect to a direction of hot gas $H_G$ (see FIG. 1) flow during operation, as will be described in greater detail herein. The first and second sidewalls 22, 24 each extend radially outwardly continuously from the bottom surface 26 of the trench 20 to the second surface 16 of the substrate 12. That is, the first and second sidewalls 22, 24 extend continuously generally perpendicular, in the radial direction between the bottom surface 26 and the second surface 16, along a length L (see FIG. 3) of the trench 20. Further, in the embodiment shown the first and second sidewalls 22, 24 are each substantially perpendicular to the first and second surfaces 14, 16 of the substrate 12. The bottom surface 26 in the embodiment shown is defined by an outer surface 28 of the inner layer 18A of the substrate 12, as shown in FIG. 2. In the embodiment shown, the bottom surface 26 is substantially parallel to the second surface 16 of the substrate 12 and also to the first surface 14 of the substrate 12.

Referring to FIGS. 1-3, a plurality of cooling passages 42 extend through the substrate 12 from the first surface 14 of the substrate 12 to the bottom surface 26 of the trench 20, i.e., the cooling passages 42 extend through the inner layer 18A in the embodiment shown. In this embodiment, the cooling passages 42 are inclined, i.e., extend at an angle θ through the substrate 12, as shown in FIG. 2. The angle θ may be, for example, about 15 degrees to about 60 degrees relative to a plane defined by the bottom surface 26, and in a preferred embodiment is between about 30 degrees to about 45 degrees. As shown in FIG. 3, the cooling passages 42 are spaced apart from each other along the length L of the trench 20.

The diameter of the cooling passages 42 may be uniform along their length or may vary. For example, throat portions 44 of the cooling passages 42 extending through the inner layer 18A of the substrate 12 may be substantially cylindrical, while outlet portions 46 of the cooling passages 42 may be elliptical, diffuser-shaped, or may have any other suitable geometry.

An outlet portion 46 of one of the cooling passages 42 will now be described, it being understood that the remaining outlet portions 46 are substantially identical to the outlet portion 46 described. The outlet portion 46 of the cooling passage 42 is the region near which that cooling passage 42 terminates at the bottom surface 26 of the trench 20. In the embodiment shown, the outlet portion 46 is defined by an inner wall 48 and first and second opposed lateral walls 50, 52. The inner wall 48 defines an inner surface for the outlet portion 46 and is bound laterally by the first and second lateral walls 50, 52. In the embodiment shown, the inner wall 48 comprises a substantially continuous planar surface extending from a proximal end 48A (FIG. 2) adjacent to the throat portion 44 to a distal end 48B (FIG. 2) at a junction of the inner wall 48 with the outer surface 28 of the inner layer 18A, although it is noted that the inner wall 48 could have other configurations, such as a curved surface. The first and second lateral walls 50, 52 extend radially outwardly from the inner wall 48 and diverge away from one another in the direction of cooling air $C_A$ flowing out of the outlet portion 46 so as to define the diffuser shape of the outlet portion 46.

The outlet portion 46 defines a rear section 54 and a front section 58. The rear section 54 receives the cooling air $C_A$ from the throat portion 44 of the cooling passage 42 and is located between the first sidewall 22 and the second sidewall 24. The front section 58 is located downstream from the first sidewall 22 between the first sidewall 22 and the distal end 48B of the inner wall 48. As shown in FIGS. 1 and 3, the first and second lateral walls 50, 52 extend from the rear section 54 to the front section 58.

As shown most clearly in FIGS. 1 and 2, the first sidewall 22 of the trench 20 extends into the outlet portion 46 of each cooling passage 42. Specifically, the first sidewall 22 extends inwardly past the outer surface 28 of the inner layer 18A to the inner wall 48 and, as seen in FIGS. 1 and 3, the first sidewall 22 extends from the first lateral wall 50 to the second lateral wall 52 so as to block the front section 58 of each outlet portion 46. According to a preferred embodiment, the first sidewall 22 is spaced from the distal end 48B of the inner wall 48 a distance of about ⅓ to about ½ a length $L_O$ (FIG. 2) of each outlet portion 46, i.e., the first sidewall 22 is spaced from the second sidewall 24 a distance of about ½ to about ⅔ the length $L_O$ of each outlet portion 46. It is noted that a length $L_D$ of the trench 20, as measured between the first and second sidewalls 22, 24 is less than the length $L_O$ of each outlet portion 46, as shown in FIG. 2.

In operation, the cooling air $C_A$, which may comprise, for example, compressor discharge air or any other suitable cooling fluid, travels from a source of cooling air (not shown) to the cooling passages 42. The cooling air $C_A$ flows through the cooling passages 42 and exits the cooling passages 42 via the outlet portions 46. As the cooling air $C_A$ flows out of the outlet portions 46, the cooling air $C_A$ is guided by a portion of each of the lateral walls 50, 52 through the rear section 54 up to the first sidewall 22, such that the cooling air $C_A$ flows into and contacts the first sidewall 22. It is noted that, as a result of the first sidewall 22 blocking the front sections 54 of the outlet portions 46, the dominant geometry of the cooling passages 42 that guides the flow of the cooling air $C_A$ out of each cooling passages 42 is the downstream end of the throat portion 44. As the cooling air $C_A$ flows out of the cooling passages 42, the cooling air $C_A$ contacts the first sidewall 22 and is forced to disperse or spread within the trench 20, which is believed to reduce the momentum of the cooling air $C_A$ in the direction of the flow of the cooling air $C_A$ out of the cooling passages 42. The spreading of the cooling air $C_A$ within the trench 20 creates a "sheet" of cooling air $C_A$ within substantially the entire trench 20 and improves film coverage of the cooling air $C_A$ within the trench 20.

The hot gas $H_G$ flows along the second surface 16 of the substrate 12 toward the trench 20, as shown in FIG. 1. Since the cooling air $C_A$ forms a sheet of cooling air $C_A$ within the trench 20 as discussed above, hot gas $H_G$ ingestion into the trench 20 is believed to be reduced. Rather, the majority of the hot gas $H_G$ is believed to flow over the trench 20 and the sheet of cooling air $C_A$ therein. Thus, the mixing of hot gas $H_G$ and cooling air $C_A$ within the trench 20 is believed to be reduced or substantially avoided, as compared to prior art cooling arrangements, such as a prior art trench 20' defined by a first sidewall, depicted by phantom line 22', located farther downstream from the second sidewall 24 than the first sidewall 22 of the present invention, as illustrated in FIGS. 1-3.

As illustrated in FIG. 1, a portion of the cooling air $C_A$ from each cooling passage 42 flows out of the trench 20 over the first sidewall 22 to the second surface 16 of the substrate 12. This portion of the cooling air $C_A$ provides film cooling to the second surface 16 of the substrate 12. Since the mixing of hot gas $H_G$ and cooling air $C_A$ within the trench 20 is believed to be reduced or substantially avoided, as discussed above, a substantially evenly distributed "curtain" of cooling fluid $C_A$ flows out of the trench 20 and washes up over the second surface 16 of the substrate 12 to provide film cooling to the second surface 16. Film cooling to the second surface 16 of the substrate 12 is believed to be improved by the substantially evenly distributed curtain of cooling fluid $C_A$ flowing out of the trench 20 to the second surface 16. Further, the forced spreading and reduction in momentum of the cooling air $C_A$ effected by the cooling air $C_A$ contacting the first sidewall 22 as it flows out of the cooling passages 42 is believed to provide increased film cooling for the second surface 16, even with the throat portions 44 of the cooling passages 42 serving as the dominant geometry guiding the flow of the cooling air $C_A$ out of the cooling passages 42, and even at high flow rates of the cooling air $C_A$ out of the cooling passages 42.

Figure 4:
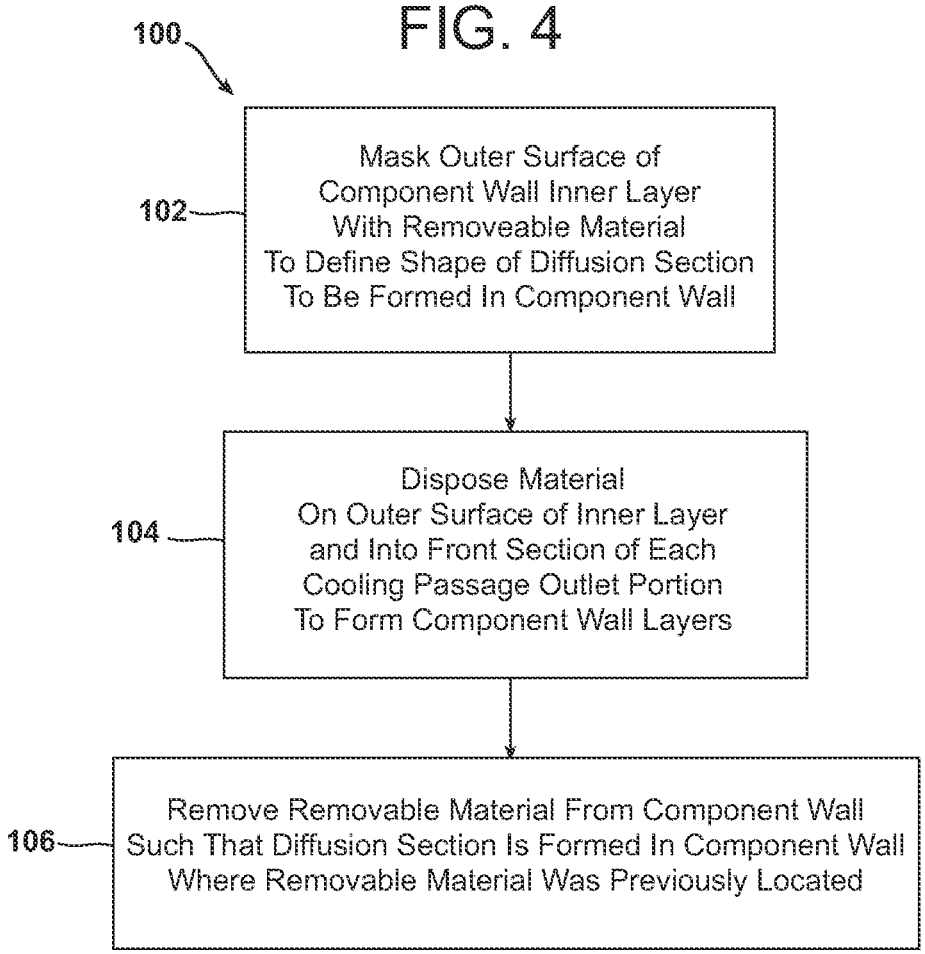
FIG. 4 illustrates a method for forming a diffusion section in a component wall according to an embodiment of the invention.

Referring to FIG. 4, a method 100 for forming a diffusion section, such as a trench, slot, or crater, in a component wall of a turbine engine is illustrated. For exemplary purposes, the component wall described herein with respect to FIG. 4 may be the same component wall 10 as described above with reference to FIG. 1-3.

Figure 4A:
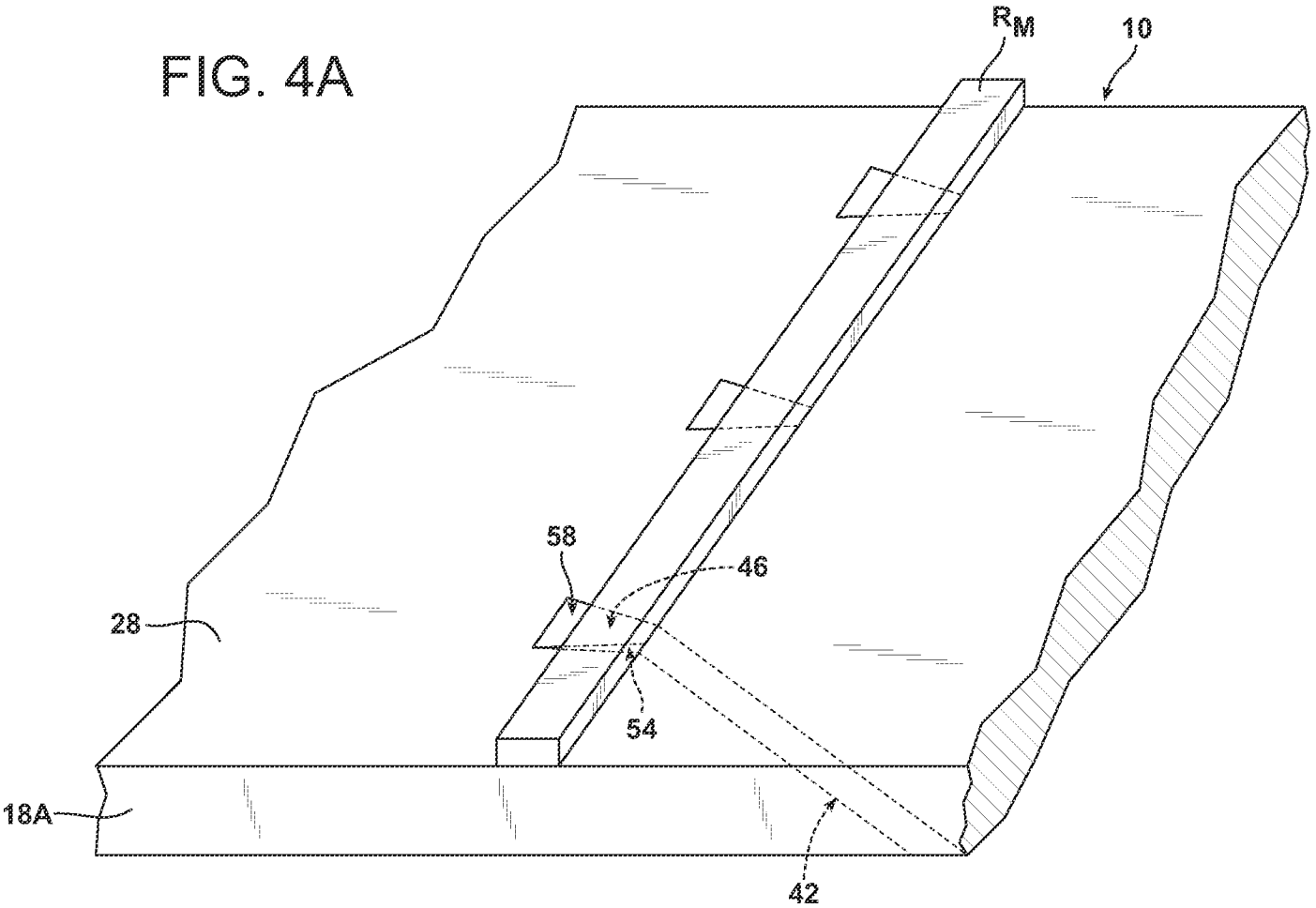
FIG. 4A illustrates a removable material used in the formation of the cooled component wall shown in FIG. 1.

At step 102, an outer surface 28 of an inner layer 18A of the component wall 10 is masked with a removable material $R_M$ (see FIG. 4A) so as to define a shape of a diffusion section to be formed in the component wall 10. The removable material $R_M$ may be, for example, a tape structure or a masking material applied with a template. The removable material $R_M$ in the embodiment shown blocks a rear section 54 of an outlet portion 46 of at least one cooling passage 42 that extends through the inner layer 18A of the component wall 10, but does not block a front section 58 of the outlet portion 46, i.e., the front section 58 of each cooling passage outlet portion 46 is not blocked from the first lateral wall 50 to the second lateral wall 52 and all the way down to the inner wall 48. In a preferred embodiment, about ⅓ to about ½ a length $L_O$ (see FIG. 2) of each outlet portion 46 is left unblocked by the removable material $R_M$.

At step 104, a material, e.g., a thermal barrier coating, is disposed on the outer surface 28 of the inner layer 18A and into the front section 58 of each cooling passage outlet portion 46 to form an outer layer 18B of the component wall 10 over the inner layer 18A, as seen in FIGS. 1 and 2. The material is disposed into the front section 58 of each cooling passage outlet portion 46 from the first lateral wall 50 to the second lateral wall 52 all the way down to an inner wall 48. Optionally, prior to disposing the outer layer 18B on the inner layer 18A, an intermediate layer 18C, e.g., a bond coat, may be applied to the inner layer 18A and into the front section 58 of each cooling passage outlet portion 46 to facilitate a bonding of the outer layer 18B to the inner layer 18A.

At step 106, the removable material $R_M$ is removed from the component wall 10 such that a diffusion section is formed in the component wall 10 where the removable material $R_M$ was previously located. The diffusion section may be defined by a bottom surface 26, a first sidewall 22, and a second sidewall 24, as shown in FIGS. 1-3. The bottom surface 26 may correspond to the surface area of the outer surface 28 of the inner layer 18A where the removable material $R_M$ was previously located. The first sidewall 22 may be defined by the material forming the outer layer 18B of the component wall 10. The first sidewall 22 extends into the front section 58 of each cooling passage outlet portion 46 all the way down to the inner wall 48 and from the first lateral wall 50 to the second lateral wall 52. The second sidewall 24 is spaced from the first sidewall 22 and may be defined by the material forming the outer layer 18B of the component wall 10.

Removing the removable material $R_M$ at step 106 unblocks the rear section 54 of each cooling passage outlet portion 46 such that cooling air $C_A$ may pass through each cooling passage 42 and out of the rear section 54 toward the first sidewall 22.

It is noted that the component wall 10 disclosed herein may comprise more than one diffusion section, which may or may not extend over the entire second surface 16 of the substrate 12. If the component wall 10 comprises multiple diffusion sections, the number, shape, and arrangement of the additional cooling passages 42 and the outlet portions 46 thereof may be the same or different than in the diffusion section described herein.

Advantageously, increased film cooling of the second surface 16 of the component wall 10 can be realized with the component wall 10 described herein as compared to existing film-cooled component walls. For example, a prior art trench 20' is schematically illustrated in FIGS. 1-3, wherein a first sidewall 22' of the trench 20' is located downstream from the outlet portions 46 of the cooling passages 42. The trench 20 disclosed herein, wherein the first sidewall 22 is located at least partially within the outlet portions 46 of the cooling passages 42, is believed to provide better film cooling coverage for the second surface 16 of the component wall 10 than the prior art trench 20'. Further, the method 100 disclosed herein may be employed to efficiently form one or more diffusion sections in a component wall 10, wherein rear sections 54 of cooling passage outlet portions 46 formed in the component wall 10 become unblocked with the removal of the removable material $R_M$, while front sections 58 remain blocked by the first sidewall 22, such that cooling air $C_A$ may flow out of the rear sections 54 but not out of the front sections 58.

Figure 6:
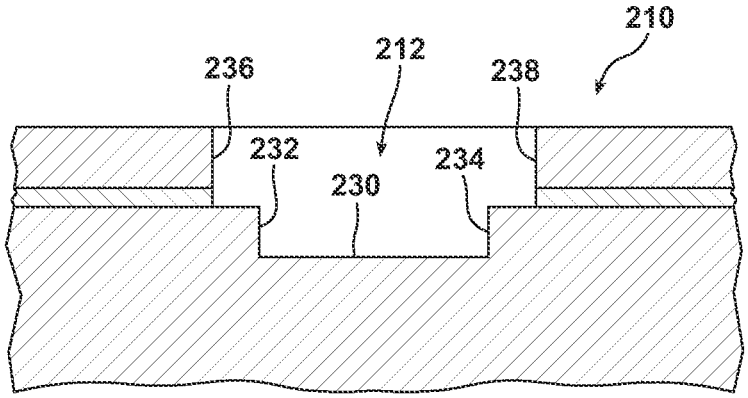
FIG. 6 is a cross section view of the cooled component wall taken along line 6-6 in FIG. 5.
Figure 5:
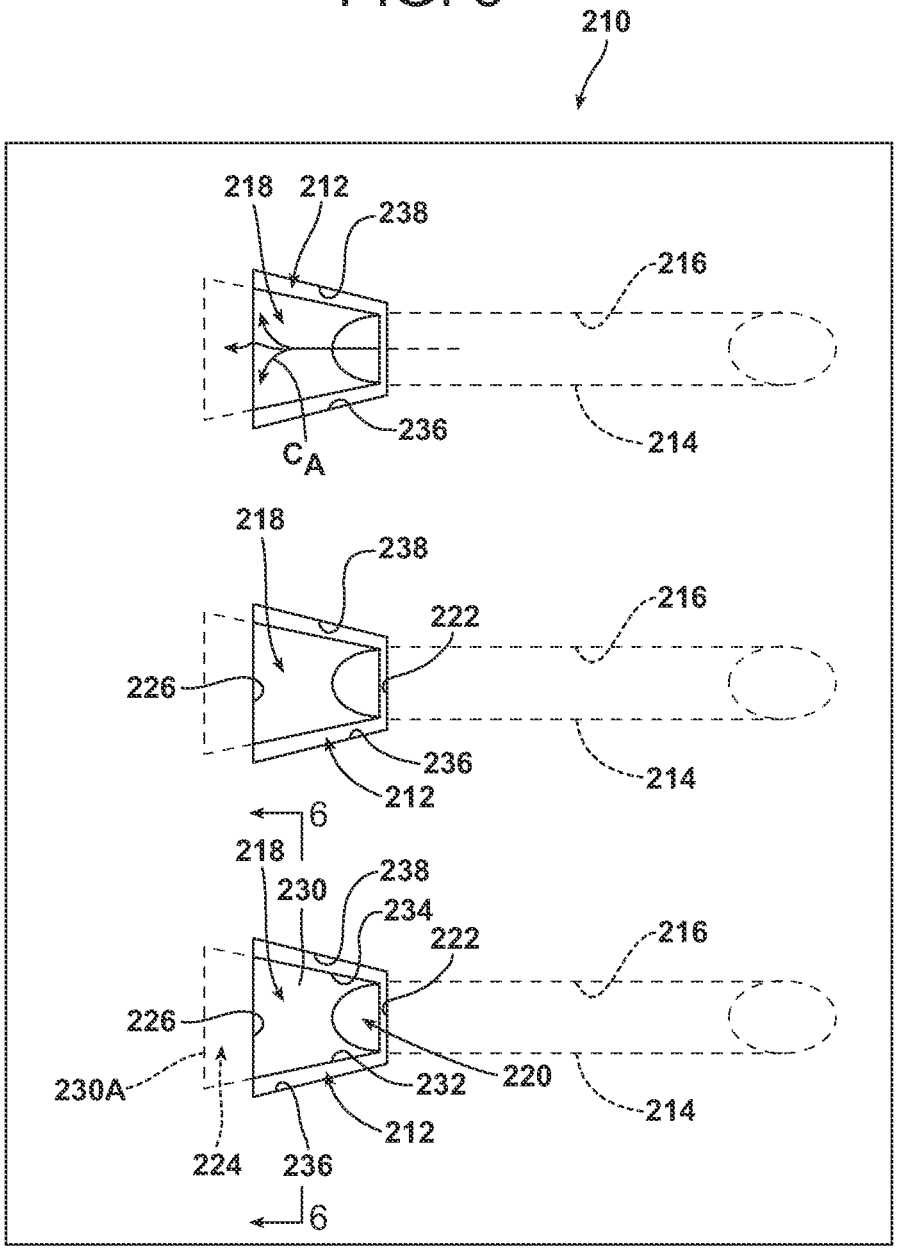
FIG. 5 is a top plan view of a cooled component wall according another embodiment of the invention.

Referring now to FIGS. 5 and 6, a component wall 210 having a plurality of diffusion sections 212 formed therein according to another embodiment is shown. In this embodiment, only the structure that is different from that described above with reference to FIGS. 1-3 will be specifically described.

According to this embodiment, rather than the diffusion sections 212 comprising trenches as described above with reference to FIGS. 1-3, the diffusion sections 212 comprise individually formed diffuser-shaped craters. Each diffusion section 212 comprises a single cooling passage 214 having a throat portion 216 and an outlet portion 218.

The outlet portion 218 of each cooling passage 214 comprises a rear section 220 located between a first sidewall 226 and a second sidewall 222 of the diffusion section 212, and a front section 224 located downstream from the first sidewall 226 between the first sidewall 226 of the diffusion section 212 and a distal end 230A of an inner wall 230 of the outlet portion 218. The inner wall 230 defines an inner surface of the outlet portion 218. The outlet portion 218 of each cooling passage 214 further comprises first and second lateral walls 232, 234 that extend from the rear section 220 to the front section 224. In the embodiment shown, the first and second lateral walls 232, 234 of each cooling passage outlet portion 218 are located adjacent to third and fourth sidewalls 236, 238 that define lateral sides of the corresponding diffusion section 212.

As shown in FIG. 5, the first sidewall 226 extends into the front sections 224 of the cooling passage outlet portions 218 all the way down to the inner walls 230 and from the first lateral walls 232 to the second lateral walls 234. The first sidewall 226 thus blocks the front sections 224 of the cooling passage outlet portions 218 such that cooling air $C_A$ passing out of the cooling passages 214 contacts the first sidewall 226 and cannot pass into and through the front sections 224. Hence, the cooling air $C_A$ passing out of the cooling passages 214 is forced to disperse or spread within the diffusion sections 212, which is believed to reduce the momentum of the cooling air $C_A$ flowing out of the cooling passage outlet portions 218. The spreading and the reduction in momentum of the cooling air $C_A$ effects the same advantages as those described above with reference to FIGS. 1-3.

The diffusion sections 212 according to FIGS. 5 and 6 may be formed by the process described above with reference to FIGS. 4 and 4A.

The diffusion sections described herein may be formed as part of a repair process or may be implemented in new component designs. Further, the diffusion sections may be formed by other processes than the one described herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A component wall in a turbine engine comprising:

a substrate having a first surface and a second surface opposed from said first surface;

a diffusion section located in said second surface, said diffusion section comprising a trench defined by a first sidewall and a second sidewall spaced from said first sidewall, said first and second sidewalls extending radially outwardly to said second surface, and said first sidewall comprises a continuous sidewall extending in a plane along a length of said trench;

a plurality of cooling passages, each cooling passage comprising a throat portion extending through said substrate and an outlet portion through which cooling air exits in a direction toward said first sidewall, said outlet portion of each cooling passage comprising:

an inner wall defining an inner surface of said outlet portion, said inner wall having a proximal end located adjacent to said throat portion and a distal end;

a rear section between said first and second sidewalls;

a front section extending between said first sidewall and said distal end of said inner wall;

a first lateral wall extending radially outwardly from said inner wall and extending from said rear section to said front section; and a second lateral wall opposed from said first lateral wall, said second lateral wall extending radially outwardly from said inner wall and extending from said rear section to said front section; and wherein said first sidewall extends into said outlet portion of each cooling passage to said inner wall and extends from said first lateral wall to said second lateral wall so as to block said front section of said outlet portion.

2. The component wall of claim 1, wherein said first and second sidewalls are substantially perpendicular to said second surface.

3. The component wall of claim 1, wherein at least one of said cooling passage outlet portions comprises a diffuser shape.

4. The component wall of claim 1, wherein each cooling passage extends through said substrate at an angle of from about 15 degrees to about 60 degrees relative to said second surface.

5. The component wall of claim 1, wherein said diffusion section is further defined by a bottom surface between said first and second surfaces, said first sidewall extending radially outwardly continuously from said bottom surface of said diffusion section to said second surface.

6. The component wall of claim 5, wherein said second surface and said bottom surface of said diffusion section are substantially parallel to one another.

7. The component wall of claim 1, wherein said first sidewall comprises an applied coating, said applied coating extending to said inner wall of each cooling passage outlet portion.

8. The component wall of claim 1, wherein said first sidewall is spaced from said second sidewall a distance of approximately ½ to ⅔ a length of each outlet portion.

9. The component wall of claim 1, wherein a length of said diffusion section between said first and second sidewalls is less than a length of each outlet portion.

10. The component wall of claim 1, wherein said inner wall of each cooling passage outlet portion comprises a substantially continuous planar surface.

11. A component wall in a turbine engine comprising:

a substrate having a first surface and a second surface opposed from said first surface;

a plurality of diffusion sections located in said second surface, each diffusion section comprising a crater, being defined by a first sidewall and a second sidewall spaced from said first sidewall, said first and second sidewalls extending radially outwardly to said second surface, wherein said first and second sidewalls are substantially perpendicular to said second surface;

each diffusion section comprising a cooling passage comprising a throat portion extending through said substrate and an outlet portion through which cooling air exits in a direction toward said first sidewall, said outlet portion of each cooling passage comprising:

an inner wall defining an inner surface of said outlet portion, said inner wall having a proximal end located adjacent to said throat portion and a distal end;

a rear section between said first and second sidewalls;

a front section extending between said first sidewall and said distal end of said inner wall;

a first lateral wall extending radially outwardly from said inner wall and extending from said rear section to said front section; and a second lateral wall opposed from said first lateral wall, said second lateral wall extending radially outwardly from said inner wall and extending from said rear section to said front section;

wherein said first sidewall extends into said outlet portion of said corresponding cooling passage to said inner wall and extends from said first lateral wall to said second lateral wall so as to block said front section of said outlet portion; and wherein said first sidewall of each said diffusion section comprises a continuous sidewall extending in a plane along a length of said crater.

* * * * *